US009272895B2

(12) United States Patent
Carter et al.

(10) Patent No.: US 9,272,895 B2
(45) Date of Patent: Mar. 1, 2016

(54) APPARATUS FOR STORING AND DISPENSING WINE

(71) Applicant: BAM! & Co., LLC, Independence, MO (US)

(72) Inventors: Berrishea Carter, St. Peters, MO (US); Michelle Bunton, Independence, MO (US)

(73) Assignee: BAM! & Co., LLC, St. Peters, MO (US)

( * ) Notice: Subject to any disclaimer, the term of this patent is extended or adjusted under 35 U.S.C. 154(b) by 0 days.

(21) Appl. No.: 14/220,911

(22) Filed: Mar. 20, 2014

(65) Prior Publication Data

US 2014/0284351 A1 Sep. 25, 2014

Related U.S. Application Data

(60) Provisional application No. 61/803,556, filed on Mar. 20, 2013.

(51) Int. Cl.
*B65D 35/56* (2006.01)
*B67D 3/00* (2006.01)

(52) U.S. Cl.
CPC ..... *B67D 3/0022* (2013.01); *B67D 3/0083* (2013.01); *B67D 3/0009* (2013.01)

(58) Field of Classification Search
CPC ..... A47G 19/12; A47G 19/127; A47G 23/04; A47J 41/0038; A47J 41/0044; A47J 41/005; A47J 41/0061; A47J 47/01; B65D 81/3825; B65D 83/0055; B65D 83/0061; B67D 3/0009; B67D 3/0054; B67D 3/0067; B67D 3/008; B67D 3/0083; B67D 3/0022
USPC ..... 222/105, 146.1, 146.6, 183, 184, 185.1
See application file for complete search history.

(56) References Cited

U.S. PATENT DOCUMENTS

| | | | | |
|---|---|---|---|---|
| 2,831,610 | A * | 4/1958 | Dennie | 222/105 |
| 3,112,047 | A * | 11/1963 | Weinreich et al. | 222/105 |
| 3,325,058 | A * | 6/1967 | West, Jr. | 222/146.5 |
| 3,435,990 | A * | 4/1969 | Pike, Jr. | 222/1 |
| 3,837,533 | A * | 9/1974 | Splan | 222/94 |
| 5,402,915 | A * | 4/1995 | Hogan | 222/105 |
| 6,293,432 | B1 * | 9/2001 | Hartwall | 222/105 |
| 6,378,719 | B1 * | 4/2002 | Kaiser | 220/475 |
| 6,454,134 | B1 * | 9/2002 | Aujesky et al. | 222/105 |
| 6,578,802 | B1 * | 6/2003 | Thier | 248/151 |
| 8,820,094 | B1 * | 9/2014 | Casher et al. | 62/3.64 |
| 2003/0213813 | A1 * | 11/2003 | Cook et al. | 222/105 |
| 2007/0056314 | A1 * | 3/2007 | Mali et al. | 62/389 |
| 2007/0187435 | A1 * | 8/2007 | Quirk | 222/481 |
| 2007/0284389 | A1 * | 12/2007 | Jacobs | 222/1 |
| 2008/0156827 | A1 * | 7/2008 | Alberto Rodrigues Anjos | 222/105 |
| 2008/0237260 | A1 * | 10/2008 | Wolek | 222/105 |
| 2008/0314927 | A1 * | 12/2008 | Martin | 222/145.1 |
| 2010/0200613 | A1 * | 8/2010 | Smith et al. | 222/105 |

(Continued)

*Primary Examiner* — Patrick M Buechner
(74) *Attorney, Agent, or Firm* — Polsinelli PC

(57) ABSTRACT

An apparatus for storing and dispensing a fluid from a flexible portable fluid container. The apparatus includes a bottom surface and at least one sidewall that defining a cavity configured to receive a flexible portable fluid container. A support member extends from the bottom surface of the body into the cavity to help support the flexible portable fluid container. An extruding member extends outwardly from the outside portion of the sidewall and defines a channel that extends from the inside portion of the sidewall through the extruding member. The channel is sized to receive the spout of the flexible portable fluid container.

15 Claims, 5 Drawing Sheets

(56) References Cited

U.S. PATENT DOCUMENTS

2012/0055955 A1* 3/2012 Fukunaga ..... 222/185.1
2012/0104041 A1* 5/2012 Coleman et al. ..... 222/95
2012/0175013 A1* 7/2012 Benayas-Perez et al. ..... 141/82
2012/0211501 A1* 8/2012 Ainsworth ..... 220/592.25
2012/0305595 A1* 12/2012 Braun et al. ..... 222/105
2013/0221030 A1* 8/2013 Middleton ..... 222/103
2013/0240562 A1* 9/2013 Middleton ..... 222/103
2014/0252031 A1* 9/2014 Norris et al. ..... 222/105

* cited by examiner

APPARATUS FOR STORING AND DISPENSING WINE

CROSS REFERENCE TO RELATED APPLICATION

Aspects of the present disclosure are described in U.S. Provisional Patent Application No. 61/803,556, titled "Apparatus For Storing and Dispensing Wine," filed on Mar. 20, 2013, the disclosure of which is hereby incorporated by reference.

FIELD OF THE DISCLOSURE

Aspects of the present disclosure involve an apparatus for storing portable fluid containers while allowing for the contents of the portable fluid containers to be dispensed.

BACKGROUND

Wine is consistently a popular drink to provide at social events and restaurants. Traditionally, wine is stored within and served from glass bottles. However, various types of wine are increasingly being stored within and made available from portable fluid containers, including a flexible bladder contained within a box, commonly known as "box wine." Such portable fluid containers generally hold between 3 to 10 liters of wine, which is significantly greater than the usual 750 milliliters that glass bottles often hold, making box wine a preferable choice for social events or restaurants serving a large number of people. However, because many people consider wine to be a premium product, box wine is often perceived to be inferior, either in terms of the wine itself or of the storage mechanism, as compared to wine stored in and served from glass bottles. For this reason alone, many people, restaurants, and groups avoid purchasing or serving wines stored in this fashion, preferring instead to purchase and serve from glass bottles.

SUMMARY

Implementations described and claimed herein address the foregoing problems by providing an apparatus for storing and dispensing wine that is aesthetically pleasing. The apparatus includes a body having a bottom surface and at least one sidewall. The bottom surface and the inside portion of the sidewall define a cavity configured to receive a flexible portable fluid container such as those used for storing wine. A support member extending from the bottom surface of the body into the cavity is used to position the flexible portable fluid container above the bottom surface and maintain the alignment between the flexible portable fluid container and an extruding member. The extruding member extends from the outside portion of the sidewall and has channel that extends from the inside portion of the sidewall through the extruding member. The spout of the flexible portable fluid container is fed through the channel. The apparatus may also include a drawer that stores a temperature regulating device used to heat or cool the contents of the flexible portable fluid container.

In one example, the apparatus also includes a base used for elevating the body above a surface such as a countertop or table. The base includes a holding surface and lip that are adapted to hold the body in place. The body may also include an opening to the cavity that allows for the flexible portable fluid container to be placed inside the cavity and a lid for covering the opening thereby concealing the opening and securing the flexible portable fluid container inside. In some examples, the support member is a tubular shape that extends upwards from the bottom surface and sized so that the spout is aligned with the extruding member.

Other implementations are also described and recited herein.

BRIEF DESCRIPTIONS OF THE DRAWINGS

DETAILED DESCRIPTIONS

Figure 1:
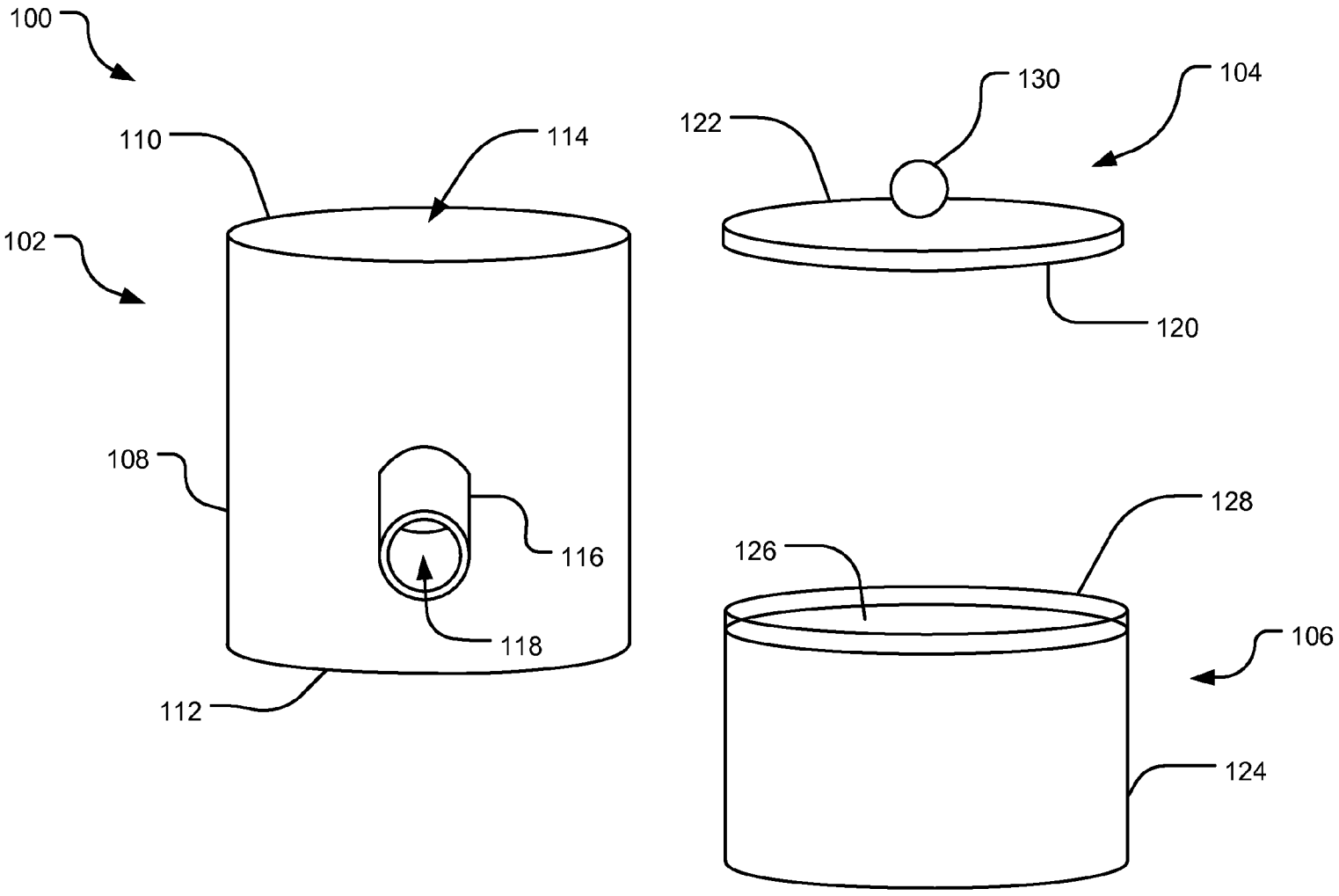
FIG. 1 illustrates a front view an example apparatus for storing and dispensing wine.

FIG. 1 illustrates a front view an example apparatus 100 for storing and dispensing wine. In one implementation, the apparatus 100 includes a housing 102, a lid 104, and a base 106. The housing 102, the lid 104, and/or the base 106 may be made from any robust material, including, but not limited to, ceramic, metal, plastic, wood, stone, or some combination of them. In some implementations the housing 102, the lid 104, and/or the base 106 include decorative features, such as patterns, colors, designs, decals, textures, or other aesthetically pleasing features. Further, one or more of the housing 102, the lid 104, and the base 106 may display a label to identify the contents stored within the housing 102. For example, a plate may be displayed on the housing 102 identifying a type of wine contained within the housing 102.

The housing 102 is adapted to receive a portable fluid container, including, without limitation, a flexible bladder holding a liquid, such as wine, soft drinks, cocktails, or other beverages or consumables. In one implementation, box wine is purchased and the flexible bladder is removed from the box and placed within the housing 102. It will be appreciated by those of ordinary skill that the portable fluid container may be any container or other apparatus adapted to hold and dispense a liquid.

The housing 102 includes a body 108, a top rim 110, and a bottom surface 112. The body 108 may be a variety of shapes, including without limitation, cylindrical, conical, cubical, polygonal, pyramidal, ellipsoidal, spherical, etc. Further, the body 108 may include one or more angular or contoured surfaces or may be sculpted into an aesthetically pleasing figure. The body 108 is sized for easy transport, storage, and presentation and for receiving a variety of sized portable fluid containers, such as a flexible bladder holding 3 to 10 liters of wine. In one implementation, the body 108 is approximately 10 inches tall and approximately 5.5 inches in diameter. The portable fluid container is removable and disposable, while the apparatus 100 is reusable and easy to clean.

In some implementations, the body 108 includes an extruding member 116 extending outwardly from the base 108, for example, a spout. The extruding member 116 has a channel 118 defined therein providing an opening into the cavity 114 for dispensing fluid from the portable fluid container. In some implementations, the channel 118 is a hole directly in the body 108 providing access to the cavity 114. The extruding member 116 may be a variety of shapes and sizes. For example, the extruding member 116 may be contoured or angled. In one implementation, the extruding member 116 is in fluid communication with the fluid stored in the portable fluid container. In another implementation, the portable fluid container includes a spout with a dispensing mechanism for dispensing the fluid, for example, a button, and the spout is threaded through the channel 118 for dispensing the fluid from within the cavity. In such cases, the extruding member 116 may be sized to conceal the spout while enabling access to the dispensing mechanism.

The top rim 110 provides an opening to a cavity 114 defined in the body 108. The top rim 110 may be, for example, smooth, contoured, or angular. However, other shapes and textures are contemplated. The bottom surface 112 is adapted to engage a holding surface, such as a table, stand, base, or floor. The bottom surface 112 is shaped such that when the housing 102 is placed on a holding surface, the housing 102 is steady and cannot be easily tipped over. For example, the bottom surface 112 may be substantially planar or include one or more indents adapted to engage indents in the holding surface to increase steadiness.

In one implementation, the lid 104 includes a lip 120, a surface 122 and a handle 130. The lip 120 is adapted to engage the top rim 110 of the housing 102, thereby securing and concealing the portable fluid container within the cavity 114. The shape of the lip 120 may mirror the shape of the top rim 110. The surface 122 may be, without limitation, generally planar, contoured, and/or angled. The handle 130 is shaped for a user to easily grab and lift the lid 104. For example, the handle 130 may be spherical, contoured, angled, etc. The lid 104 is sized to mirror the housing 102. In one implementation, the lid 104 is approximately 3 to 4 inches in diameter. However, other dimensions are contemplated.

The base 106 is adapted to hold the housing 102 by engaging the bottom surface 112. In one implementation, the base 106 includes a stand 124, a holding surface 126, and a lip 128. The stand 124 may be a generally solid or hollow body, legs, or other components for elevating the holding surface 126 off the ground or a serving surface, such as a table. The holding surface 126 is adapted to engage the bottom surface 112. The holding surface 126 may be a variety of shapes and sizes that generally mirror the bottom surface 112. For example, the holding surface 126 may be substantially planar or include one or more indents adapted to engage indents in the bottom surface 112 to increase steadiness. In one implementation, the lip 128 extrudes from the holding surface 126 to provide additional stability for the housing 102. The base 106 may be a variety of heights suitable for easy dispensing and access, including, for example, approximately 4 inches tall.

Figure 2:
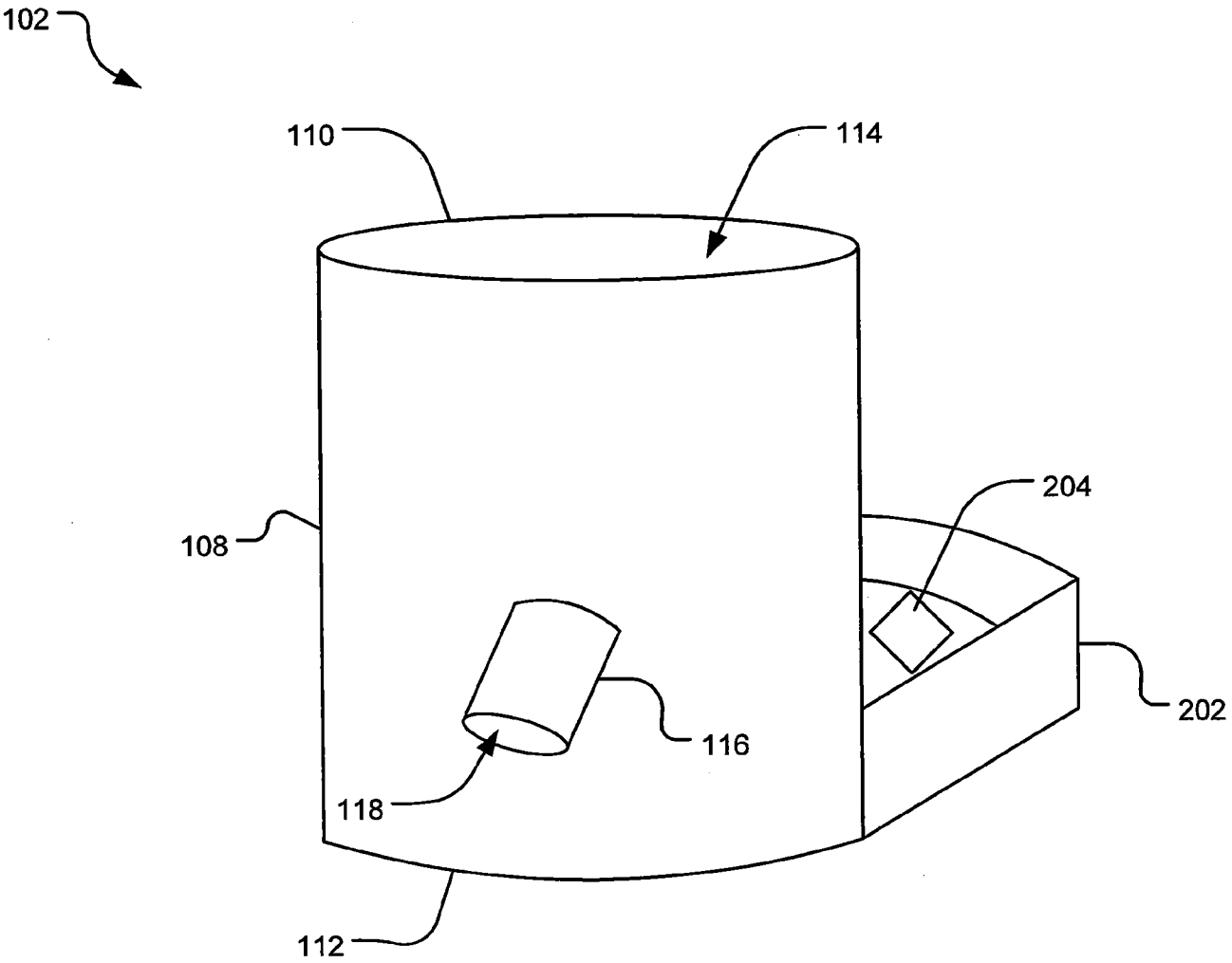
FIG. 2 illustrates a side perspective view the apparatus of FIG. 1 showing a cooling drawer in an open position.

Some implementations include a temperature system configured to keep the contents contained in the housing 102 within a certain temperature range. For example, as shown in FIG. 2, the temperature system may include a drawer 202. Ice or other coolants 204 may be placed within the drawer 202 to keep the contents contained in the housing 102 chilled or cold. On the other hand, heating mechanisms 204 may be placed within the drawer 202 to keep the contents warm or hot. For example, white wine is generally served chilled, so ice or other coolants 204 may be placed in the drawer 202 so that when the white wine is dispensed from the housing 102, the white wine is chilled. Further, if a warm drink, such as cider or hot chocolate is being served from the housing 102, heaters or other heating mechanisms 204 may be placed in the drawer 202 to serve the beverage hot.

Figure 3:
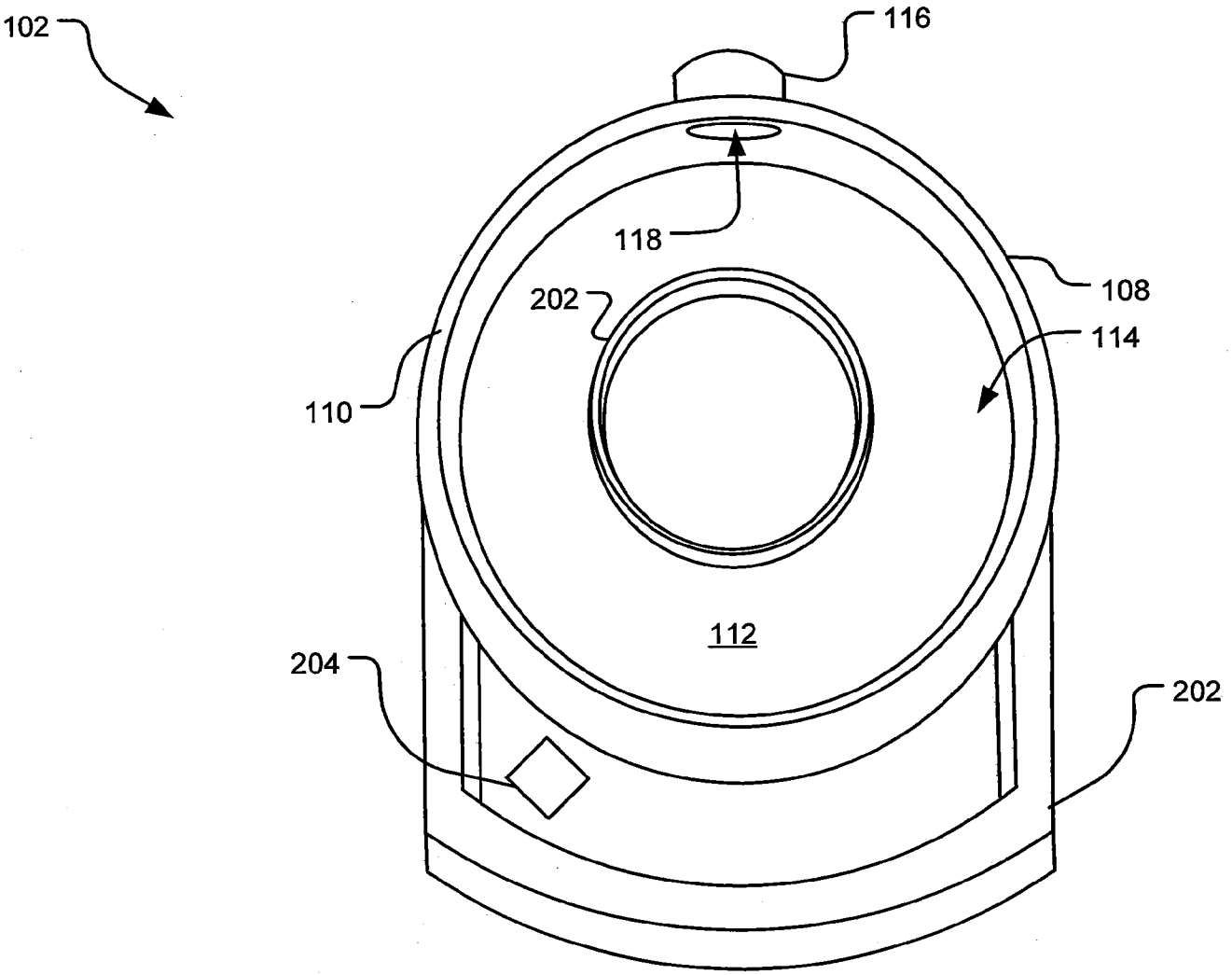
FIG. 3 illustrates a top view of the apparatus of FIG. 2.

As can be understood from FIG. 3, the drawer 202 may slide in below the bottom surface 112. In such implementations, the portable fluid container may be placed within the cavity 114 on the bottom surface 112. In such cases, the bottom surface 112 would be heated or cooled from by the contents 204 of the drawer 202, and the bottom surface 112 would heat or cool the contents in the portable fluid container. The housing 102 may include a support member 302 extending from the bottom surface 112 to hold the portable fluid container in a position relative to the channel 118 to ensure that the fluid may be dispensed from the portable fluid container. In one example, the support member 302 has a tubular shape that extends from the bottom surface 112 and is sized to prevent the fluid container from moving. For example, in some cases, the portable fluid container may be flexible. The support member 302 is therefore shaped to facilitate the ability to hold the portable fluid container in place. Further, the support member 302 holds the portable fluid container relative to the temperature system to maintain the contents at a desired temperature. In other implementations, the temperature system may be integrated into the body 108 or spread throughout the cavity 114 for uniform cooling and heating of the contents of the portable fluid container.

Figure 4:
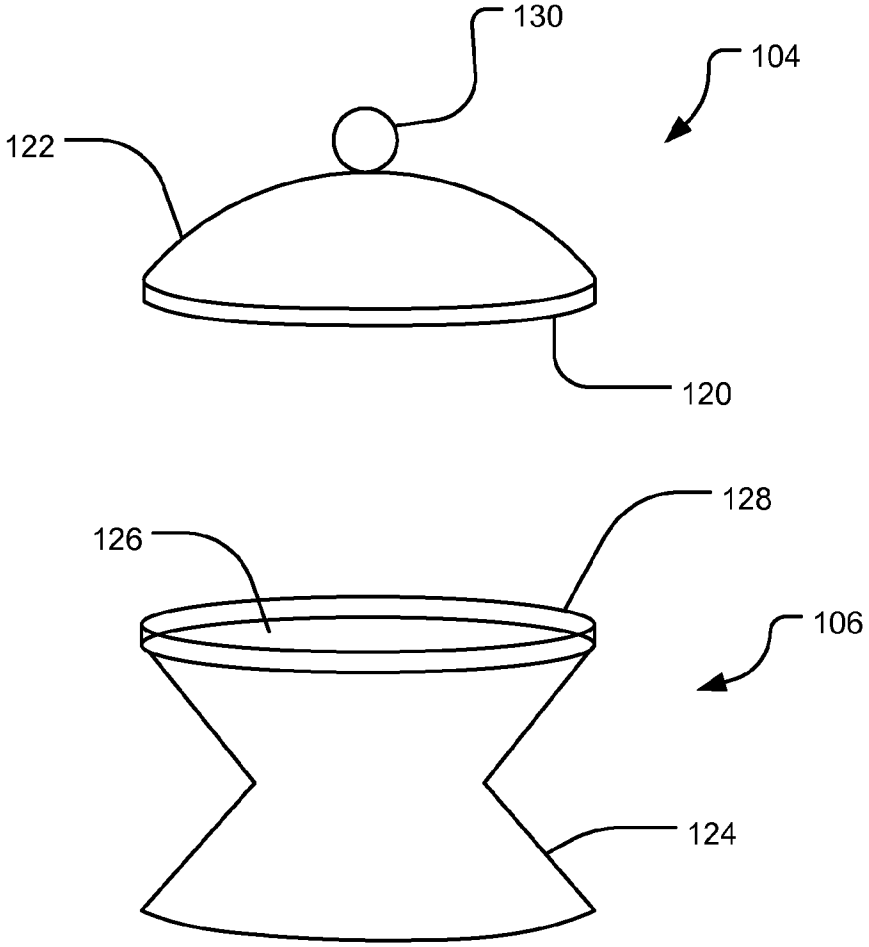
FIG. 4 illustrates a front view of an example base and lid.
Figure 5:
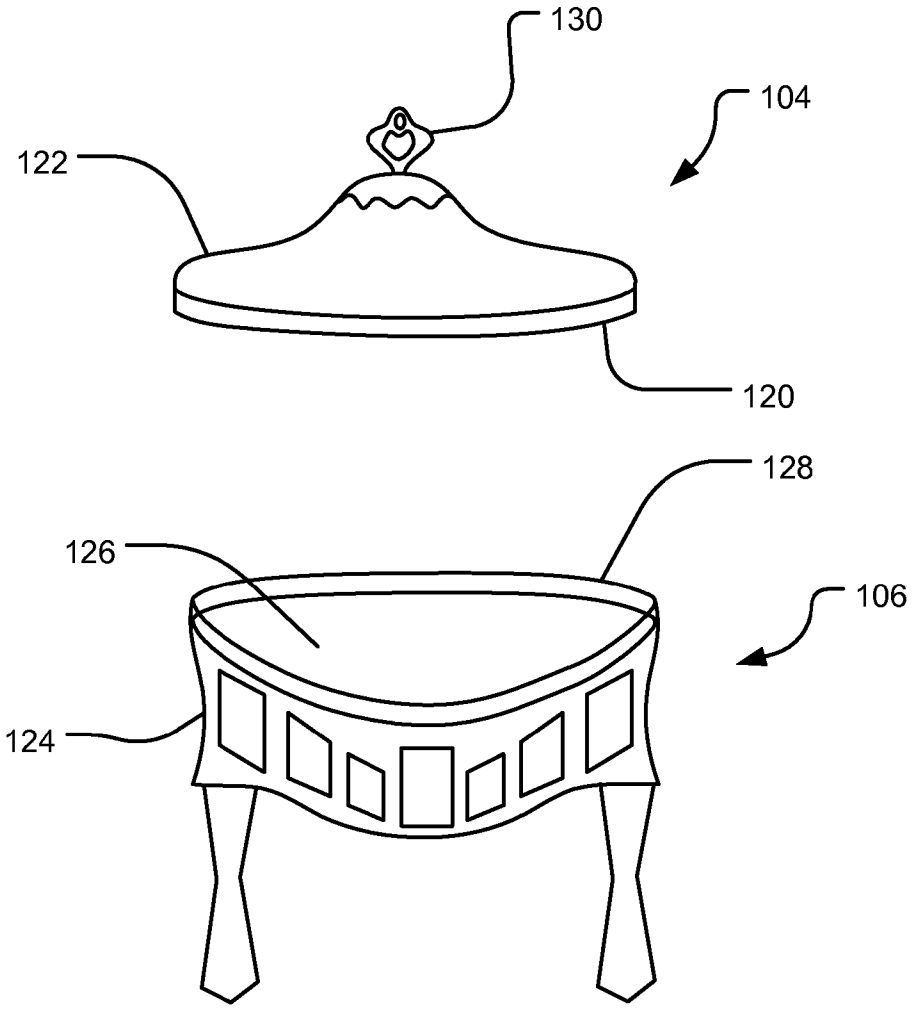
FIG. 5 illustrates a front view of another example base and lid.

The apparatus 100 may come in a variety of shapes, designs, and styles. For example, FIGS. 4 and 5 illustrate example modern and rustic styles, respectively. As shown in FIG. 4, the surface 122 of the lid 104 may be contoured, for example, forming a hemi-ellipsoidal shape, and the handle 130 of the lid 104 may be generally spherical. The stand 124 of the base 106 is a solid or hollow, angled body. FIG. 5 shows the surface 122 of the lid 104 being contoured to form a bulge shape having a design, and the handle 130 is shaped to form a design. The stand 124 of the base 106 includes a body having a design with legs extending from the body. The legs are shown with a contoured shape. Other shapes, designs, and styles are contemplated.

All directional references (e.g., proximal, distal, upper, lower, upward, downward, left, right, lateral, front, back, top, bottom, above, below, vertical, horizontal, clockwise, and counterclockwise) are only used for identification purposes to aid the reader's understanding of the presently disclosed technology and do not create limitations, particularly as to the position, orientation, or use of the presently disclosed technology.

The above specification and examples provide a complete description of the structure and use of exemplary implementations. Although various implementations have been described above with a certain degree of particularity, or with reference to one or more individual implementations, those skilled in the art could make numerous alterations to the disclosed implementations without departing from the spirit or scope of the presently disclosed technology. Other implementations are therefore contemplated. It is intended that all matter contained in the above description and shown in the accompanying drawings shall be interpreted as illustrative only of particular implementations and not limiting. Changes in detail or structure may be made without departing from the basic elements of the presently disclosed technology, as defined in the following claims.

What is claimed is:

1. An apparatus for storing and dispensing a fluid, the apparatus comprising:

a body including a bottom surface and at least one sidewall with an inside portion and an outside portion, the bottom surface and the inside portion of the sidewall defining a cavity configured to receive a flexible portable fluid container including a spout for dispensing a fluid from within the flexible portable fluid container;

a support member extending from the bottom surface of the body into the cavity, the support member for positioning the flexible portable fluid container above the bottom surface; and an extruding member extending from the outside portion of the sidewall and defining a channel that extends from the inside portion of the sidewall through the extruding member, the channel sized to receive the spout of the flexible portable fluid container, wherein the support member defines a tubular shape extending upwards from the bottom surface and sized so that the spout is aligned with the extruding member.

2. The apparatus of claim 1, wherein the body includes a drawer positioned in contact with the bottom surface, the drawer configured to receive a temperature regulator, wherein the temperature regulator is in thermal communication with the portable fluid container when the drawer is closed.

3. The apparatus of claim 2, wherein the temperature regulator comprises a coolant.

4. The apparatus of claim 2, wherein the temperature regulator comprises a heating element.

5. The apparatus of claim 1, further comprising a base configured to elevate the body, the base comprising:

a base bottom adapted to engage a flat surface;

a support extending upwards from the base bottom and defining a holding surface adapted to engage the body; and a lip extending from the holding surface, wherein the holding surface and lip hold the body in a static position.

6. The apparatus of claim 1, wherein the sidewall defines an opening to the cavity, the apparatus further comprising a lid shaped substantially similar to the opening and includes a lip configured to engage the sidewall and cover the opening.

7. An apparatus for storing and dispensing a fluid, the apparatus comprising:

a base;

a body including a bottom surface and at least one sidewall with an inside portion and an outside portion, the bottom surface and the inside portion of the sidewall defining a cavity configured to receive a flexible portable fluid container including a spout for dispensing a fluid from within the flexible portable fluid container;

a support member extending from the bottom surface of the body into the cavity, the support member for positioning the flexible portable fluid container above the bottom surface;

an extruding member extending from the outside portion of the sidewall and defining a channel that extends from the inside portion of the sidewall through the extruding member, the channel sized to receive the spout of the flexible portable fluid container, wherein the support member defines a tubular shape extending upwards from the bottom surface and sized so that the spout is aligned with the extruding member; and a lid shaped substantially similar to an opening of the cavity and includes a lip configured to engage the sidewall and cover the opening;

wherein the base includes:

a base bottom adapted to engage a flat surface;

a support extending upwards from the base bottom and defining a holding surface adapted to engage the body; and a lip extending from the holding surface, wherein the holding surface and lip hold the body in a static position.

8. The apparatus of claim 7, wherein the body includes a drawer positioned in contact with the bottom surface, the drawer configured to receive a temperature regulator, wherein the temperature regulator is in thermal communication with the portable fluid container when the drawer is closed.

9. The apparatus of claim 8, wherein the temperature regulator comprises a coolant.

10. The apparatus of claim 8, wherein the temperature regulator comprises a heating element.

11. An apparatus for storing and dispensing a fluid, the apparatus comprising:

a body including;

a bottom surface;

a drawer positioned within the body, the drawer configured to receive a temperature regulator; and at least one sidewall with an inside portion and an outside portion, the bottom surface and the inside portion of the sidewall defining a cavity configured to receive a flexible portable fluid container including a spout for dispensing a fluid from within the flexible portable fluid container, wherein the temperature regulator is in thermal communication with the portable fluid container when the drawer is closed;

a support member extending from the bottom surface of the body into the cavity the support member for positioning the flexible portable fluid container above the bottom of the body; and an extruding member extending from the outside portion of the sidewall and defining a channel that extends from the inside portion of the sidewall through the extruding member, the channel sized to receive the spout of the flexible portable fluid container, wherein the support member defines a tubular shape extending upwards from the bottom surface and sized so that the spout is aligned with the extruding member.

12. The apparatus of claim 11, wherein the temperature regulator comprises a coolant.

13. The apparatus of claim 11, wherein the temperature regulator comprises a heating element.

14. The apparatus of claim 11, further comprising a base, the base comprising:

a base bottom adapted to engage a flat surface;

a support extending upwards from the base bottom and defining a holding surface adapted to engage the bottom of the body; and a lip extending from the holding surface, wherein the holding surface and lip hold the body in a static position.

15. The apparatus of claim 11, wherein the sidewall defines an opening to the cavity, the apparatus further comprising a lid shaped substantially similar to the opening and includes a lip configured to engage the sidewall and cover the opening.

* * * * *